United States Patent [19]

Kawaguchi

[11] Patent Number: 4,552,133

[45] Date of Patent: Nov. 12, 1985

[54] RAPID EXHAUST VALVE FOR USE IN BLOOD CIRCULATION STIMULATOR

[75] Inventor: Mamoru Kawaguchi, Arita, Japan

[73] Assignee: Kawaei Co., Ltd., Arita, Japan

[21] Appl. No.: 638,715

[22] Filed: Aug. 8, 1984

[30] Foreign Application Priority Data

Aug. 18, 1983 [JP] Japan ..... 58-128286
Aug. 18, 1983 [JP] Japan ..... 58-128287

[51] Int. Cl.[4] ..... A61H 23/04

[52] U.S. Cl. ..... 128/44; 128/67; 137/102; 251/61.1

[58] Field of Search ..... 137/102; 128/203.11, 128/207.15, 207.16, 25 R, 39, 41, 44, 67, 33; 251/61.1

[56] References Cited

U.S. PATENT DOCUMENTS

| | | | |
|---|---|---|---|
| 2,698,711 | 1/1955 | Newcomd | 251/61.1 |
| 3,093,153 | 6/1963 | Horowitz | 137/102 |
| 3,242,921 | 3/1966 | Seeler | 128/203.11 |
| 3,460,558 | 8/1969 | Johannisson | 137/102 |
| 3,880,149 | 4/1975 | Kawaguchi | 128/24 |
| 4,057,046 | 11/1977 | Kawaguchi | 128/24 |
| 4,175,297 | 11/1979 | Robbins | 128/33 |
| 4,178,940 | 12/1979 | Au | 128/207.15 |
| 4,355,653 | 10/1982 | Credle | 251/61.1 |

FOREIGN PATENT DOCUMENTS

| | | | |
|---|---|---|---|
| 427561 | 8/1911 | France | 128/39 |
| 345943 | 1/1937 | Italy | 128/207.16 |
| 748363 | 5/1956 | United Kingdom | 137/102 |
| 1034759 | 7/1966 | United Kingdom | 137/102 |

*Primary Examiner*—Clyde I. Coughenour
*Attorney, Agent, or Firm*—Wenderoth, Lind & Ponack

[57] ABSTRACT

A rapid exhaust valve for use in a blood circulation stimulator which supplies and exhausts an air to and from an air bag provided on the human body, thereby subjecting to repeated pressure application and release.

A valve box, which is provided with an exhaust port on the circumferential wall thereof, is provided with a flexible band valve diaphragm therein. If a compressed air is supplied into said valve box through a compressed-air supply pipe, said valve diaphragm is pushed by the pressure to close said exhaust port and a part of said valve diaphragm is projected into an air bag from an opening communicating with said air bag to allow the compressed air flow into said air bag. When the pressure in said air bag reaches high, said flexible valve diaphragm is deformed so that it may close said compressed-air supply pipe to release said exhaust port whereby rapidly discharging the compressed air out of said air bag.

2 Claims, 7 Drawing Figures

RAPID EXHAUST VALVE FOR USE IN BLOOD CIRCULATION STIMULATOR

The present invention relates to a rapid exhaust valve incorporated in a blood circulation stimulator which helps to stimulate the circulation of blood in the human body by subjecting it to repeated pressure application and release by the use of a compressed air.

It is known that subjecting a portion of the human body to repeated application and release of external pressure stimulates the circulation of blood at the pressure-applied portion, thereby assisting in the cure of a disease.

Although such a blood circulation stimulator as described above, in which subjecting to application and release of external pressure can be automatically and reliably carried out by the use of a compressed air, consists of an air bag surrounding the desired portion of the human body and a compressed-air source for supplying a compressed air to said air bag, it is known that the more quickly released a compressed air, that is to say, pressure is, the better.

Accordingly, it is an object of the present invention to provide a rapid exhaust valve in which a rapid release of pressure can be sensitively and reliably carried out.

It is another object of the present invention to provide a rapid exhaust valve which is simple in construction and can accurately operate.

It is a further object of the present invention to provide a rapid exhaust valve which is small-sized and can be easily mounted on an air bag.

The above described and other objects and features of the present invention will be more detailedly understood with reference to an embodiment and the accompanying drawing, wherein.

Figure 1:
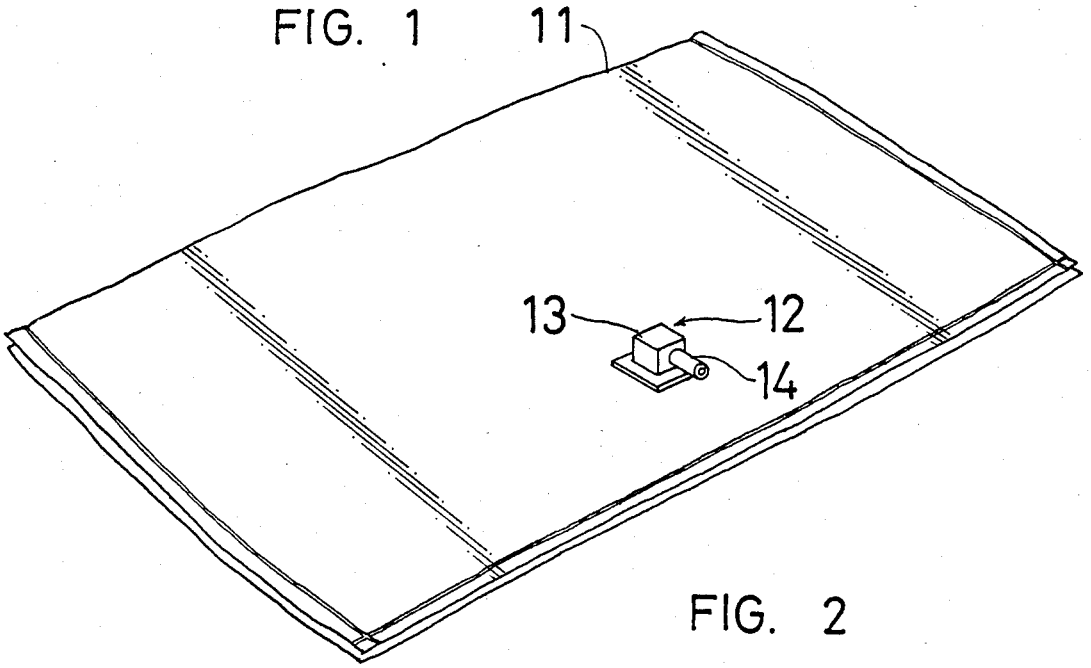
FIG. 1 is a perspective view showing the first example of a rapid exhaust valve according to the present invention mounted on an air bag.
Figure 2:
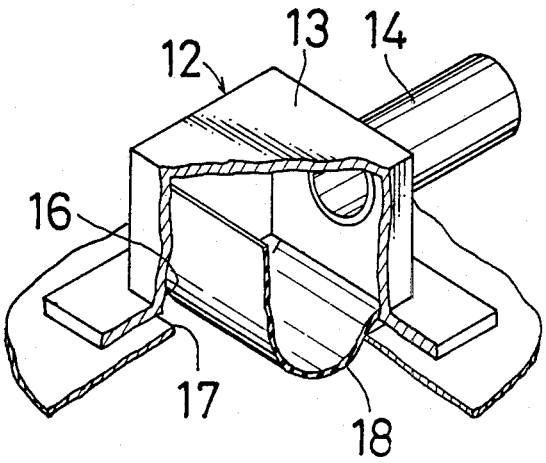
FIG. 2 is a partially-cutaway perspective view showing a rapid exhaust valve as shown in FIG. 1.

Referring now to FIGS. 1 to 4, a rapid exhaust valve 12 is mounted on an air bag 11 at the desired position thereof, said air bag 11 being connected with a compressed-air supply source such as compressor and pump through said exhaust valve 12.

In the case shown, said air bag 11 is formed from air tight and flexible materials so that the inside thereof may be hollow and worn by winding around the head and the like.

Said rapid exhaust valve 12 is provided with a compressed-air supply pipe 14 on one side of circumferential walls of a rectangular valve box 13 and an exhaust port 15 on another side opposite to said compressed-air supply pipe 14.

Said valve box 13 is fixedly mounted on said air bag 11 air-tightly so that an underside opening 16 thereof may be communicated with an opening 17 provided in said air bag 11, a flexible band valve diaphragm 18 being incorporated in said valve box 12, and the action of said valve diaphragm 18 carrying out the introduction of a compressed air into said air bag 11 from said compressed-air supply pipe 14 and the exhaust of an air from said air bag 11.

Figure 3:
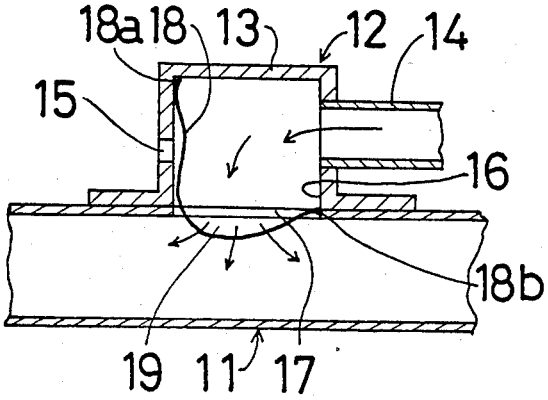
FIG. 3 is a sectional view of a rapid exhaust valve showing the state of a compressed air flowing into said air bag.

Said valve diaphragm 18 has almost the same width as the internal width of said valve box 13. As shown in FIG. 3, one end 18*a* of said valve diaphragm 18 is fixed at a corner portion just above said exhaust port 15 on the inside of said valve box 13 while another end 18*b* of said valve diaphragm 18 is fixed at a corner portion just under said compressed-air supply pipe 14, so that the slackened portion of said valve diaphragm 18 may be hung inside said air bag 11 from said opening 17 and compressed-air supply conduits 19 may be formed at both sides of said slackened portion.

The operation of the first example of a rapid exhaust valve 12 according to the present invention having the above described construction and mounted on said air bag 11 will be described. When a compressed air is supplied to said air bag 11 through said valve box 13 from said compressed-air supply source connected with said compressed-air supply pipe 14, a compressed air is introduced into said valve box 13 to press said valve diaphragm 18 as shown by an arrow in FIG. 3.

At this time, said valve diaphragm 18 is pressed against the inside of said valve box 13 so as to cover and close said exhaust port 15, the lower slackened portion projecting into said air bag 11 through said opening 17, and a compressed air being introduced into said air bag 11 under pressure through said conduits 19 formed on both sides of said slackened portion.

Figure 4:
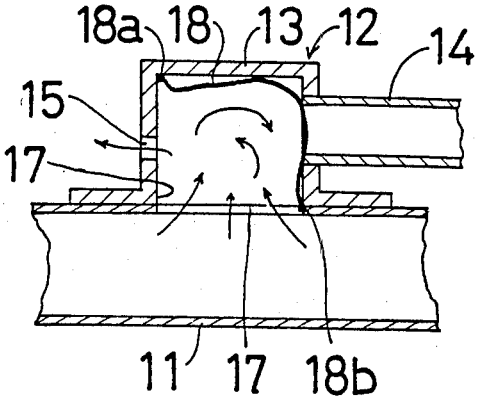
FIG. 4 is a sectional view of a rapid exhaust valve showing the state of a compressed air when exhausted.

Then, when the pressure of an air inside said air bag 11 reaches higher than that in said compressed-air supply pipe 14 by stopping the supply of a compressed air and the like, an air from said air bag 11 flows backward in the direction of an arrow in FIG. 4. As a result, said valve diaphragm 18 is pushed on in said valve box 13 to cover and close said compressed-air supply pipe 14 and simultaneously release said exhaust port 15 whereby rapidly discharge an air out of said air bag 11.

In addition, when a compressed air is introduced again into said air bag 11 through said compressed-air supply pipe 14, said valve diaphragm 18 covers and closes said exhaust port 15 as shown in FIG. 3 whereby introducing a compressed air into said air bag 11 under pressure.

Then, the second to fourth examples of a rapid exhaust valve 12 according to the present invention shown in FIGS. 5 to 7 will be described. The same parts as the first example are similarly marked.

Each of these second to fourth examples is provided with an exhaust port of compressed air in an inclined manner or a curved manner so that said exhaust port of compressed air may be displaced from the inserting direction of a compressed-air supply pipe by the appointed angle whereby making the closure of said exhaust port or said compressed-air supply pipe by a valve diaphragm complete.

Figure 5:
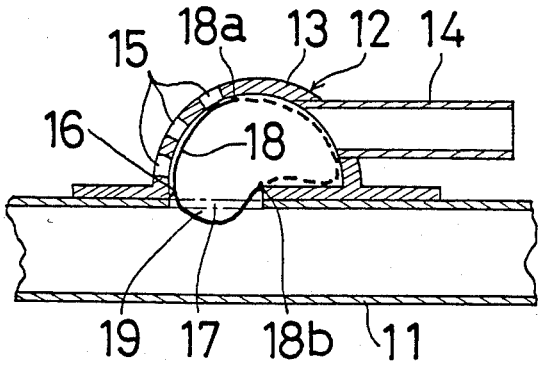
FIG. 5 is a longitudinal sectional view showing the second example of a rapid exhaust valve according to the present invention.

In the second example shown in FIG. 5, a valve box 13 is of a semispherical shape, a compressed-air supply pipe 14 being connected in the horizontal manner in parallel to an air bag 11, and an exhaust port 15 being provided on an archwise circumferential wall whereby making said exhaust port 15 dislocate from said compressed-air supply pipe 14 in a curved manner.

Figure 6:
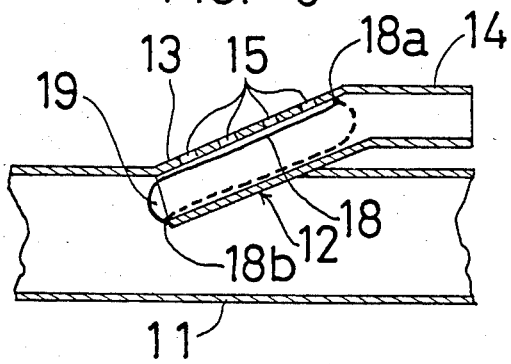
FIG. 6 is a longitudinal sectional view showing the third example of a rapid exhaust valve according to the present invention.

In the third example shown in FIG. 6, a valve box 13 being of almost similar tubular shape as a compressed-air supply pipe 14 is incorporated between said compressed-air supply pipe 14 and an air bag 11 in an inclined manner, an exhaust port 15 being formed on the upper inclined plane.

Figure 7:
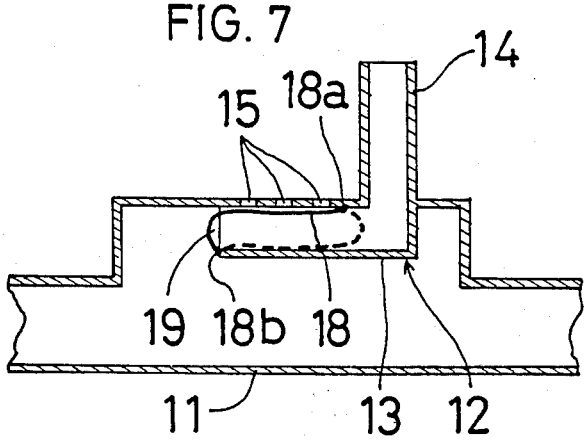
FIG. 7 is a longitudinal sectional view showing the fourth example of a rapid exhaust valve according to the present invention.

In the fourth example shown in FIG. 7, a compressed-air supply pipe 14 is inserted vertically to an air bag 11, a tubular valve box 13 to be housed in said air bag 11 being connected vertically to an end portion of said compressed-air supply pipe 14, and an exhaust port 15 being formed on the upper circumferential wall of said valve box 13.

As described above, since in the second to fourth examples an exhaust port 15 is provided in a inclined manner or a curved manner to a compressed-air supply pipe 14, a valve diaphragm 18 can snugly fit to said exhaust port 15 to close it when a compressed-air is supplied to an air bag 11 while said compressed-air supply pipe 14 can be completely closed when compressed air is exhausted from said air bag 11 to said exhaust port 15.

As described above, since, according to a rapid exhaust valve 12 of the present invention, an exhaust port is closed by a flexible valve diaphragm 18 when compressed air is supplied while said exhaust port 15 is opened and a compressed-air supply pipe 14 is closed when compressed air is discharged out of an air bag 11, the supply and discharge of compressed air to and out of an air bag can be automatically carried out. In addition, since an exhaust port can be released at one stroke, the exhaust is stimulated and the blood circulation stimulating effect by an air bag can be improved.

What is claimed is:

1. A rapid exhaust valve for use in a blood circulation stimulator, in which the human body is subjected to repeated application and release of external pressure by means of an air bag and the like, characterized by that it comprises a valve box mounted so as to be communicated with said air bag and a flexible band valve diaphragm incorporated in said valve box, said valve box being connected with a compressed-air supply pipe and provided with an exhaust port at one portion of a circumferential wall thereof, said flexible valve diaphragm having almost the same width as the internal width of said valve box, one end of said flexible valve diaphragm being fixed between said compressed-air supply pipe and said exhaust port inside said valve box while another end of said flexible valve diaphragm being fixed between said compressed-air supply pipe and said air bag, and a reflected portion having a length of such a degree of projecting from said valve box into the inside of said air bag.

2. A rapid exhaust valve for use in a blood circulation stimulator as set forth in claim 1, in which said exhaust port of said valve box is dislocated from the injecting direction of said compressed-air supply pipe by the appointed angle.

* * * * *